US007599650B2

(12) United States Patent
Katoh et al.

(10) Patent No.: US 7,599,650 B2
(45) Date of Patent: Oct. 6, 2009

(54) DEVELOPER BEARING MEMBER, DEVELOPING DEVICE, PROCESS CARTRIDGE AND IMAGE FORMING APPARATUS

(75) Inventors: Shunji Katoh, Sagamihara (JP); Katsumi Masuda, Yokohama (JP); Hideo Yoshizawa, Sagamihara (JP); Yoshio Hattori, Kawasaki (JP); Hideki Kimura, Yokohama (JP); Kiyotaka Sakai, Kawasaki (JP); Kenji Nakajima, Sagamihara (JP); Keiichi Yoshida, Kawasaki (JP); Akira Azami, Yokohama (JP); Yuji Suzuki, Ota-ku (JP)

(73) Assignee: Ricoh Company Limited, Tokyo (JP)

( * ) Notice: Subject to any disclaimer, the term of this patent is extended or adjusted under 35 U.S.C. 154(b) by 371 days.

(21) Appl. No.: 11/554,360

(22) Filed: Oct. 30, 2006

(65) Prior Publication Data

US 2007/0104516 A1 May 10, 2007

(30) Foreign Application Priority Data

| | | |
|---|---|---|
| Nov. 4, 2005 | (JP) | 2005-321625 |
| Nov. 4, 2005 | (JP) | 2005-321626 |
| Nov. 4, 2005 | (JP) | 2005-321627 |
| Nov. 4, 2005 | (JP) | 2005-321628 |
| Nov. 4, 2005 | (JP) | 2005-321629 |
| Nov. 30, 2005 | (JP) | 2005-345049 |

(51) Int. Cl.
*G03G 15/08* (2006.01)

(52) U.S. Cl. ..... 399/279; 399/286

(58) Field of Classification Search ..... 399/279, 399/286

See application file for complete search history.

(56) References Cited

U.S. PATENT DOCUMENTS 5,182,601 A 1/1993 Hodoshima et al.

(Continued)

FOREIGN PATENT DOCUMENTS

JP 61-147264 7/1986

(Continued)

OTHER PUBLICATIONS

U.S. Appl. No. 10/652,505, filed Sep. 2, 2003, Eisaku Murakami, et al.

(Continued)

*Primary Examiner*—Hoang Ngo
(74) *Attorney, Agent, or Firm*—Oblon, Spivak, McClelland, Maier & Neustadt, L.L.P.

(57) ABSTRACT

A developer bearing member on which grooves slanting in a thrust direction of the developer bearing member cross other grooves reversely slanting relative to the thrust direction, wherein each of the grooves and the reversely slanting grooves is slanting at an angle of greater than 0° and not greater than 40°. Any two adjacent intersections of the grooves and the reversely slanting grooves in the thrust (or peripheral) direction are preferably on different levels in the peripheral (or thrust) direction. The distance between two adjacent intersections in the thrust direction is preferably from 1.3 mm to 4.8 mm. The distance between two adjacent intersections in the thrust direction is preferably from 0.38 Vd/Vi (mm) to 1.1 Vd/Vi (mm). The deviation in depth of grooves present on a 36° arc surface portion of the member is not greater than 15% of the gap between the image bearing member and the developer bearing member.

54 Claims, 13 Drawing Sheets

U.S. PATENT DOCUMENTS

| | | | | |
|---|---|---|---|---|
| 5,321,473 | A | | 6/1994 | Azami |
| 5,387,966 | A | * | 2/1995 | Karashima ..... 399/286 |
| 5,456,782 | A | * | 10/1995 | Fujita et al. ..... 156/184 |
| 5,493,382 | A | | 2/1996 | Takagaki et al. |
| 5,604,575 | A | | 2/1997 | Takagaki et al. |
| 5,737,680 | A | | 4/1998 | Takagaki et al. |
| 5,794,108 | A | | 8/1998 | Yoshizawa et al. |
| 5,909,609 | A | | 6/1999 | Yahata et al. |
| 5,970,294 | A | | 10/1999 | Narita et al. |
| 6,070,038 | A | | 5/2000 | Imamura et al. |
| 6,112,042 | A | | 8/2000 | Imamura et al. |
| 6,118,951 | A | | 9/2000 | Kato et al. |
| 6,198,895 | B1 | | 3/2001 | Tsuda et al. |
| 6,337,957 | B1 | | 1/2002 | Tamaki et al. |
| 6,522,855 | B1 | | 2/2003 | Katoh et al. |
| 6,553,202 | B2 | | 4/2003 | Tamaki et al. |
| 6,795,673 | B2 | | 9/2004 | Yoshizawa |
| 6,859,634 | B2 | | 2/2005 | Itoh et al. |
| 6,895,203 | B2 | | 5/2005 | Ozeki et al. |
| 6,898,406 | B2 | | 5/2005 | Suzuki et al. |
| 6,904,244 | B2 | | 6/2005 | Azami et al. |
| 6,993,267 | B2 | | 1/2006 | Yoshiyuki et al. |
| 6,993,281 | B2 | | 1/2006 | Yoshizawa et al. |
| 7,003,235 | B2 | | 2/2006 | Azami et al. |
| 7,027,753 | B2 | | 4/2006 | Suzuki |
| 7,095,971 | B2 | | 8/2006 | Ozeki et al. |
| 7,110,699 | B2 | | 9/2006 | Yoshizawa et al. |
| 2005/0111882 | A1 | | 5/2005 | Sudo et al. |

FOREIGN PATENT DOCUMENTS

| | | |
|---|---|---|
| JP | 7-13410 | 1/1995 |
| JP | 2000-206780 | 7/2000 |
| JP | 2000-242073 | 9/2000 |
| JP | 2003-208012 | 7/2003 |
| JP | 2003-316146 | 11/2003 |
| JP | 2004-334092 | 11/2004 |
| JP | 2005-37878 | 2/2005 |

OTHER PUBLICATIONS

U.S. Appl. No. 10/932,038, filed Sep. 2, 2004, Yoshio Hattori.
U.S. Appl. No. 12/015,787, filed Jan. 17, 2008, Hori, et al.
U.S. Appl. No. 12/188,549, filed Aug. 8, 2008, Hori, et al.

* cited by examiner

DEVELOPER BEARING MEMBER, DEVELOPING DEVICE, PROCESS CARTRIDGE AND IMAGE FORMING APPARATUS

BACKGROUND OF THE INVENTION

1. Field of the Invention

The present invention relates to a developer bearing member for visualizing a latent image using a developer including a toner. In addition, the present invention also relates to a developing device using the developer bearing member, and a process cartridge and an image forming apparatus using the developing device.

2. Discussion of the Background

Recently, copiers and printers are required to produce high quality images while having a good combination of reliability and stability. In order to satisfy such requirements, it is preferable to form a uniform developer layer on the peripheral surface of the developer bearing member, which is used for developing a latent image, over a long period of time. Therefore, developing rollers, the surface of which is roughened by sandblasting or has plural V-form grooves extending in a direction parallel to the rotation axis of the developing rollers, have been typically used for conventional developer bearing members.

When the roughness of the sandblasted surface of the developing rollers is too small, the developing rollers have poor developer bearing ability. When the roughness of the surface of the developing rollers is increased to improve the developer bearing ability thereof, a problem which occurs is that the developer bearing rollers are deformed in the manufacturing process.

The developing rollers having plural V-form grooves extending in a direction parallel to the rotation axis thereof have a drawback in that a large amount of stress is applied to the developer on the surface of the developing rollers when (the edge of) each of the plural grooves passes above (or below) a developer layer forming member. This is because each of the grooves is parallel to the developer layer thickness controlling member and therefore the entire portion of each of the plural grooves passes above (or below) the developer layer thickness controlling member at the same time. In addition, the developing rollers having plural V-form grooves have another drawback in that the amount of developer in the peripheral direction (i.e., the rotation direction) of the developing rollers varies when the shapes (such as depth) of the grooves vary, resulting in formation of uneven density images.

In attempting to remedy the drawbacks of the developing rollers having plural V-form grooves extending in a direction parallel to the rotation axis thereof, published unexamined Japanese patent applications Nos. 2003-316146, 2003-208012, 2000-242073 and 07-13410 have disclosed developing rollers, the surface of which has plural grooves which are slanting relative to the direction parallel to the rotation axis thereof.

When such slanting grooves are formed on the surface of a developing roller, a problem in that the developer bearing ability of the developing roller deteriorates after long repeated use occurs depending on the conditions of the slanting grooves. In this case, the degree of deterioration of the developer bearing ability of the developing roller is greater than that in a developing roller having plural grooves parallel to the rotation axis thereof. Further, a problem in that an undesired horizontal stripe image having a horizontal high-density portion at regular intervals is formed occurs depending on the conditions of the slanting grooves. Furthermore, a problem in that an undesired vertical stripe image having a vertical high density portion at regular intervals is formed occurs depending on the conditions of the slanting grooves.

Because of these reasons, a need exists for a developer bearing member which can maintain its developer bearing ability even after long repeated use without causing the above-mentioned stripe image problems.

SUMMARY OF THE INVENTION

As one aspect of the present invention, a developer bearing member for bearing a developer including a toner while rotating to visualize a latent image on a rotating latent image bearing member using the developer is provided which has a surface on which grooves are formed such that plural grooves slanting in the thrust direction (i.e., a direction perpendicular to the rotation (peripheral) direction of the image bearing member) cross other plural grooves reversely slanting relative to the thrust direction.

The slanting angle is preferably greater than 0° and not greater than 40°.

The distance between any two adjacent intersections of the plural grooves in the trust direction is preferably from 1.3 mm to 4.8 mm.

Any two adjacent intersections of the plural grooves are preferably on different levels in the rotation direction.

The distance (b) between any two adjacent intersections of the plural grooves in the rotation direction preferably satisfies the following relationship:

$$0.38\ Vd/Vi\ (mm) \leqq b \leqq 1.1\ Vd/Vi\ (mm),$$

wherein Vd represents the linear velocity of the surface of the developer bearing member, and Vi represents the linear velocity of the surface of the rotated image bearing member.

The deviation in the depth (i.e., difference between the deepest groove and the shallowest groove) of grooves present on an arc surface portion of a cross section of the developer bearing member is not greater than 15% of the gap between the image bearing member and the developer bearing member, wherein the sector formed by the arc portion and a center of the cross section has an angle of 36°.

As another aspect of the present invention, a developing device is provided which includes the above-mentioned developer bearing member; a developer container containing a two-component developer including a toner and a magnetic carrier; a developer feeding member configured to feed the developer in the developer container to the developer bearing member while agitating the developer; and a developer layer thickness controlling member configured to control the thickness of the developer layer on the developer bearing member.

As yet another aspect of the present invention, a process cartridge is provided which includes the above-mentioned developing device; and at least one of an image bearing member configured to bear a latent image to be developed by the developing device, a charging device configured to charge an image bearing member and a cleaning device configured to clean the surface of an image bearing member.

As a further aspect of the present invention, an image forming apparatus is provided which includes a latent image bearing member and the above-mentioned developing device which develops a latent image on the latent image bearing member with a developer including a toner to form a toner image on the latent image bearing member. The image forming apparatus preferably includes one or more of the process cartridge mentioned above.

These and other objects, features and advantages of the present invention will become apparent upon consideration of the following description of the preferred embodiments of the present invention taken in conjunction with the accompanying drawings.

DETAILED DESCRIPTION OF THE INVENTION

At first, the image forming apparatus of the present invention will be explained referring to drawings.

Figure 1:
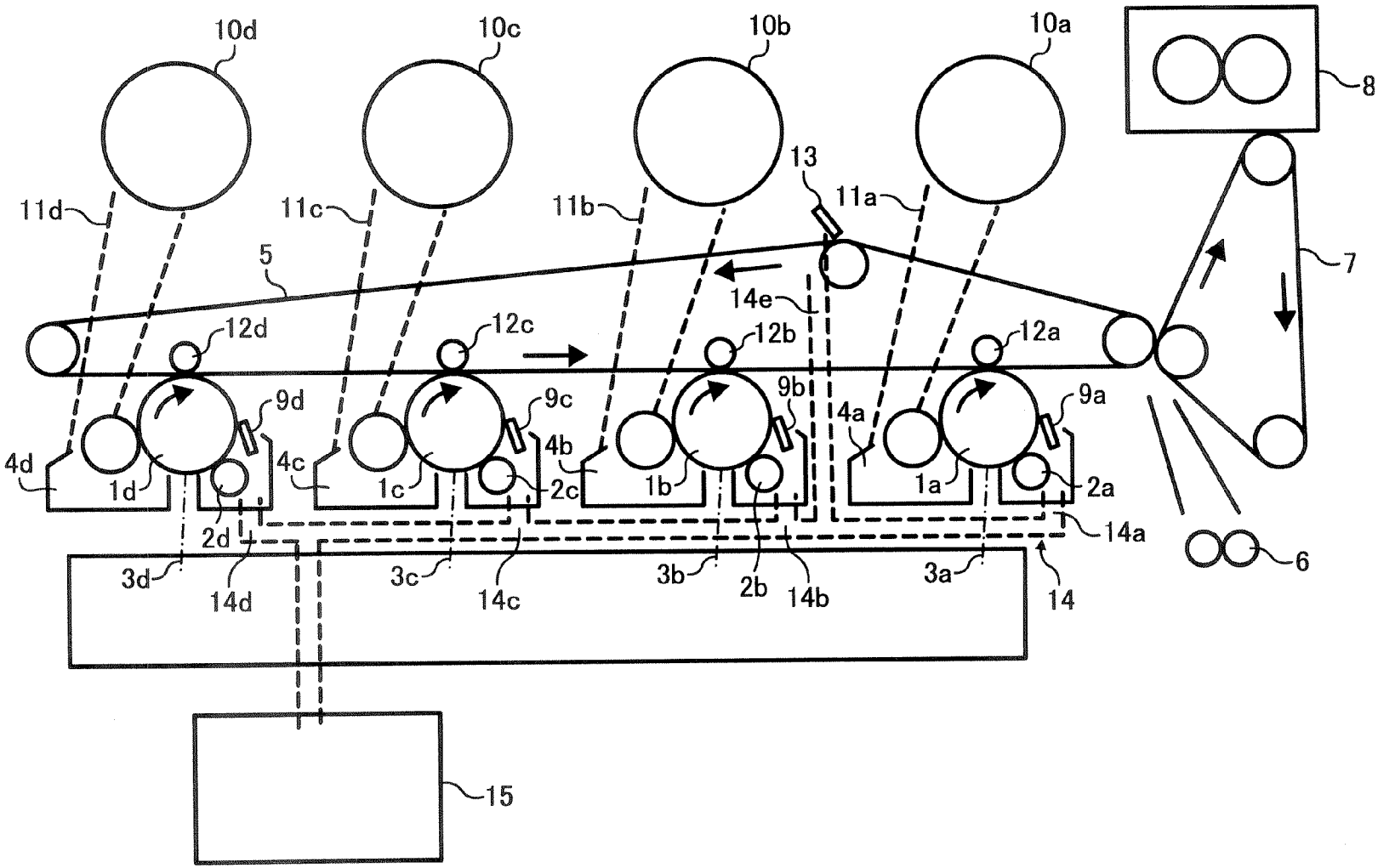
FIG. 1 is a schematic view illustrating a printer, which is an embodiment of the image forming apparatus of the present invention.

The image forming section of an embodiment of the image forming apparatus of the present invention, which is a tandem color copier and has an intermediate transfer medium, is illustrated in FIG. 1. The image forming apparatus includes four photoreceptors 1*a*, 1*b*, 1*c* and 1*d*, and an intermediate transfer belt 5 which is arranged so as to face the four photoreceptors. The photo receptors 1*a*, 1*b*, 1*c* and 1*d* are charged with respective charging rollers 2*a*, 2*b*, 2*c* and 2*d*, which serve as charging means. Light beams 3*a*, 3*b*, 3*c* and 3*d*, each of which includes image information, irradiate the charged photoreceptors, thereby forming latent images on the photoreceptors 1*a*, 1*b*, 1*c* and 1*d*. The thus prepared latent images are developed with respective developing devices 4*a*, 4*b*, 4*c* and 4*d* using color developers, resulting in formation of color toner images on the respective photoreceptors. The thus prepared color toner images are then transferred one by one onto the intermediate transfer belt 5 by respective transfer rollers (serving as transfer means) 12*a*, 12*b*, 12*c* and 12*d*. Thus, the color toner images are overlaid on the intermediate transfer belt 5.

The thus overlaid color toner images are then transferred at the same time onto a receiving paper (serving as a receiving material), which has been fed to the transfer region by a pair of registration rollers 6, by a transfer belt 7. The color toner images thus transferred on the receiving paper are fixed with a fixing device 8 (serving as fixing means), which applies heat to the toner images, resulting in formation of a multi-color copy. The thus prepared multi-color copy is discharged to a tray (not shown).

Toner particles remaining on the surface of the photoreceptors 1 without being transferred are scraped from the surface of the photoreceptors using respective cleaning blades 9*a*, 9*b*, 9*c* and 9*d*. The photoreceptors 1 are then discharged with discharging devices (not shown) so as to be ready for the next image forming operation. The toner particles scraped off the photoreceptors are collected and fed to a waste toner container 15 through passages 14 (14*a*, 14*b*, 14*c* and 14*d*).

Toner particles remaining on the intermediate transfer belt 5 or toner particles used for forming a test image (which is formed for checking image qualities and for controlling the image forming conditions) on the intermediate transfer belt 5 are scraped from the intermediate transfer belt with an intermediate transfer belt cleaning blade 13 (serving as cleaning means). The toner particles are also collected and fed to the waste toner container 15 through a passage 14*e*.

Fresh toners are supplied to the respective developing devices. Specifically, fresh toners contained in respective toner bottles (not shown) are fed to toner hoppers 11*a*, 11*b*, 11*c* and 11*d*, which are provided on the rear sides of the main body of the image forming apparatus, using toner replenishing devices 10*a*, 10*b*, 10*c* and 10*d*. When a toner density detecting device 21 (illustrated in FIG. 2) judges that the toner density is low in one of the developing devices 4, a toner replenishing screw (not shown) provided in the toner hopper 11 is rotated to feed a proper amount of toner to the developing device. Whether the toner is present in the toner bottle is determined using a toner presence/absence sensor (not shown) provided in the toner hopper 11. Specifically, when the toner presence/absence sensor judges that the toner is absent in the toner bottle, the image forming apparatus requires to supply a fresh toner to the toner replenishing device 10. If the toner presence/absence sensor does not detect presence of the toner even after a predetermined time, the image forming apparatus judges that there is no toner in the toner bottle.

Figure 2:
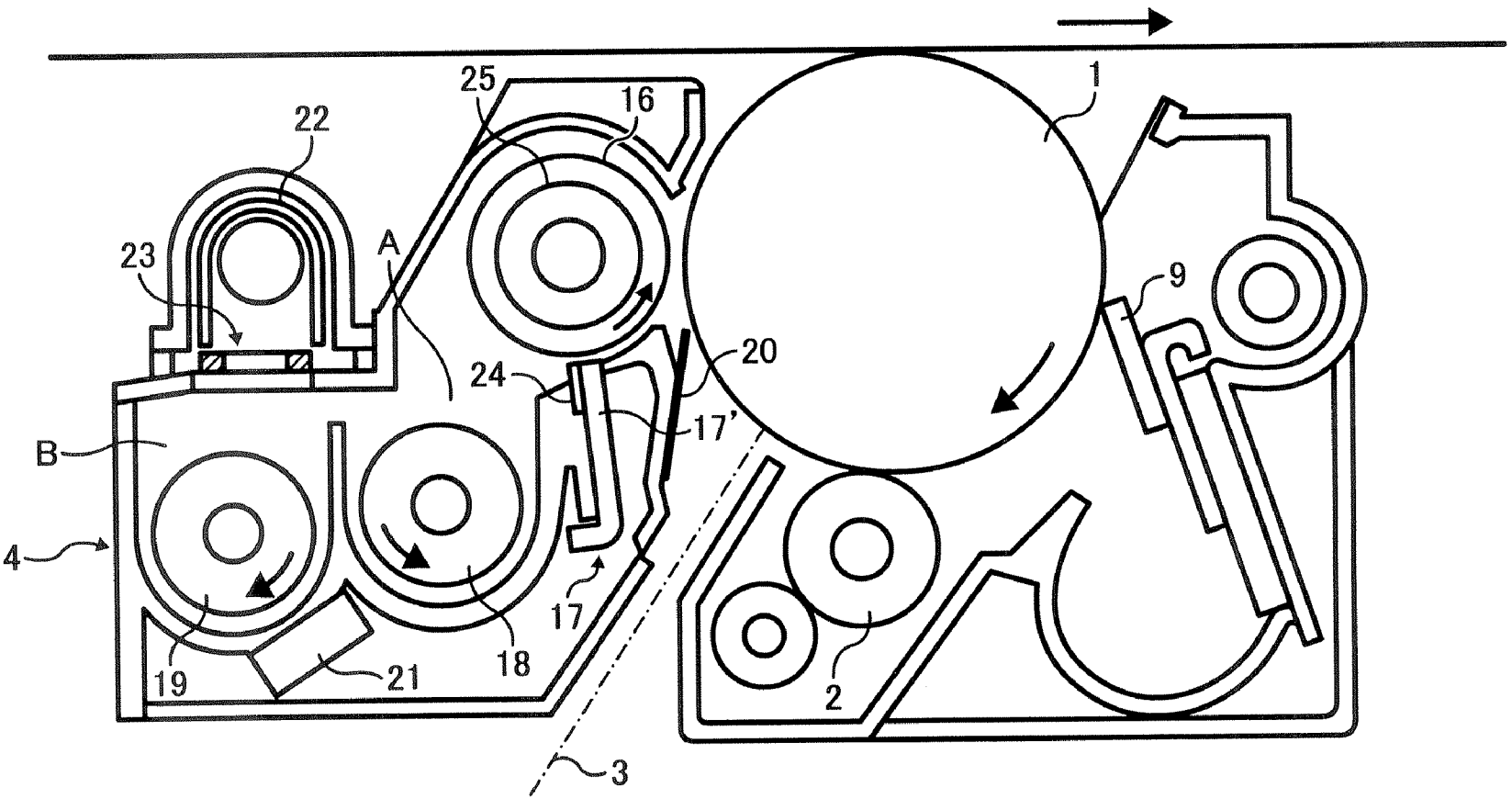
FIG. 2 is a schematic view illustrating the image forming section of the printer illustrated in FIG. 1.

FIG. 2 is an enlarged view illustrating one of the four units of the image forming section. Since the four units have the same configuration, suffixes a, b, c and d are omitted in FIG. 2. In this image forming apparatus, the photoreceptor 1, the developing device 4, the charging roller 2 (serving as charging means) and the cleaning blade 9 (serving as cleaning means) are united to form a process cartridge. The process cartridge can be detachably attached to the main body of the image forming apparatus. The developing device 4 has a developing roller 16*c* on figured to supply the developer including a toner to the photoreceptor 1. The developing device 4 also has a doctor 17, which is located on a downstream side from the development region, at which the developing roller 16 faces the photoreceptor 1, relative to the rotation direction of the developing roller. The doctor 17 is configured to control the thickness of the developer layer formed on the developing roller 16.

A two component developer including a toner and a particulate magnetic material (serving as a carrier) is contained in a development tank of the developing device 4. The developer in the development tank is circulated therein by a first feeding screw 18 and a second feeding screw 19. In addition, the toner concentration sensor 21 is arranged below the second feeding screw 19 to check the concentration of the toner in the developer in the development tank so that the toner concentration is controlled so as to fall in a predetermined range. The fresh toner fed from the toner supplying portion is provisionally contained in a sub-hopper (not shown). When the toner concentration sensor 21 detects that the concentration of toner in the developer in the development tank is lower than the predetermined range, a toner replenishing screw 22 is rotated for a predetermined time, which is determined by calculation on the basis of the relationship between the amount of toner to be fed to the development tank and the rotation time of the toner replenishing screw 22. Thus a proper amount of toner is fed to the development tank through a toner feed opening 23.

A seal 20 is arranged in the vicinity of the doctor 17 (on a right side of the doctor 17 in FIG. 2) to prevent the developer (toner) from being scattered.

The doctor 17 includes a main body 17' of the doctor made of a non-magnetic material and an auxiliary doctor 24 made of a magnetic material. The main body 17' of the doctor 17 serves to control the thickness of the toner layer so as to fall in the predetermined range. Since the main body receives the developer particles on the surface of the rotated developing roller to form a developer layer, the main body 17' of the doctor 17 preferably has a thickness of from about 1.5 mm to about 2 mm and the tip of the main body preferably has straightness of about 0.05 mm. The auxiliary doctor 24 serves to supplementarily charge the toner layer formed on the surface of the developing roller 16 and is typically made of a metal plate having a thickness of about 0.2 mm. The positional relationship between the auxiliary doctor 24 and the main body 17' of the doctor 17 is preferably maintained severely in order that the developer layer is evenly charged in the longitudinal direction of the developing roller 16. Therefore, it is preferable to fix the auxiliary doctor 24 to the main body 17' of the doctor 17 by a method such as spot welding or caulking such that the gap between the tip of the main body 17' of the doctor 17 and the auxiliary doctor 24 and the surface of the developing roller is controlled so as to be constant. In the embodiment of the image forming apparatus, the doctor 17 is located below the center of the developing roller 16.

Figure 3:
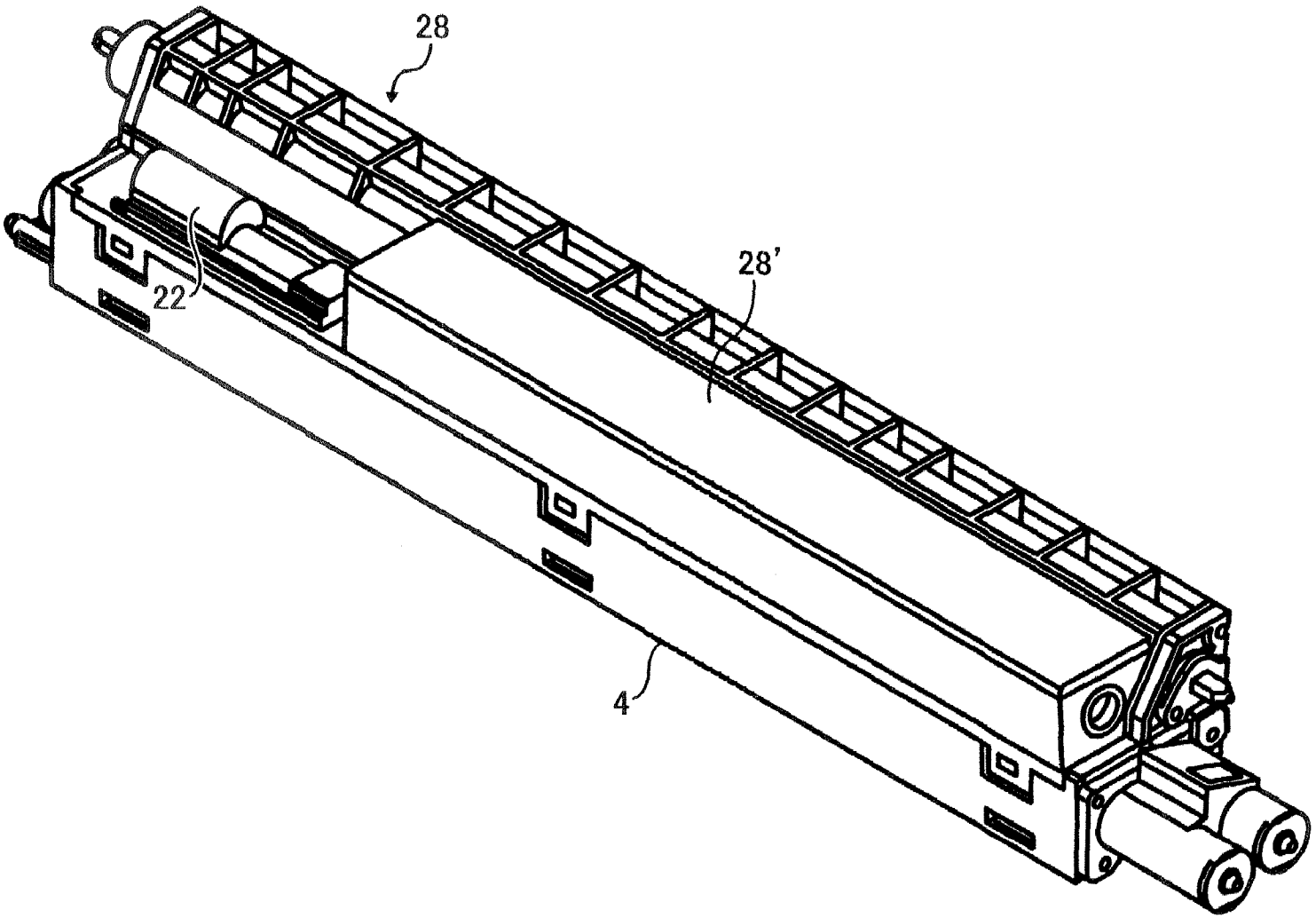
FIG. 3 is a perspective view illustrating the developing device of the printer, which is an embodiment of the developing device of the present invention.

FIG. 3 is a perspective view illustrating the entire of the developing device 4 The developing device 4 includes an upper case 28 having a preset space 28' in which the developer is contained. When the unit (i.e., the process cartridge) is shipped, the developer in the preset space 28' is sealed using a sealing member. When the unit is set in an image forming apparatus, the sealing member is removed therefrom such that the developer can be used for development. Thus, leakage of the developer during transportation can be prevented.

Figure 4:
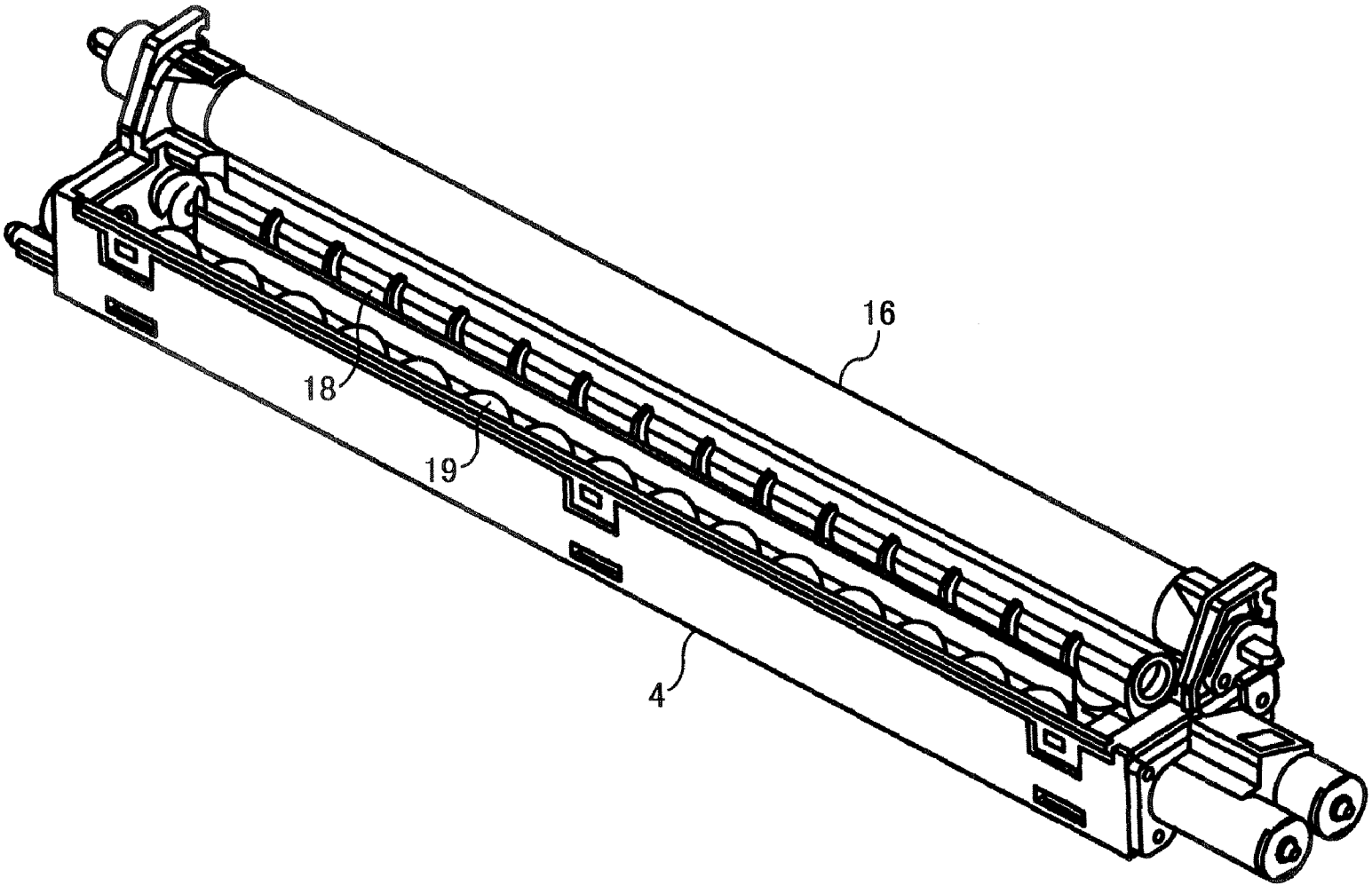
FIG. 4 illustrates the inside of the developing device illustrated in FIG. 3.

FIG. 4 illustrates the developing device 4 from which the upper case 28 is removed therefrom. In this figure, the developing roller 16, the first feeding screw 18 and the second feeding screw 19 can be observed. The first and second feeding screws circulate the developer between a first developer containing portion A and a second developer containing portion B.

Figure 5:
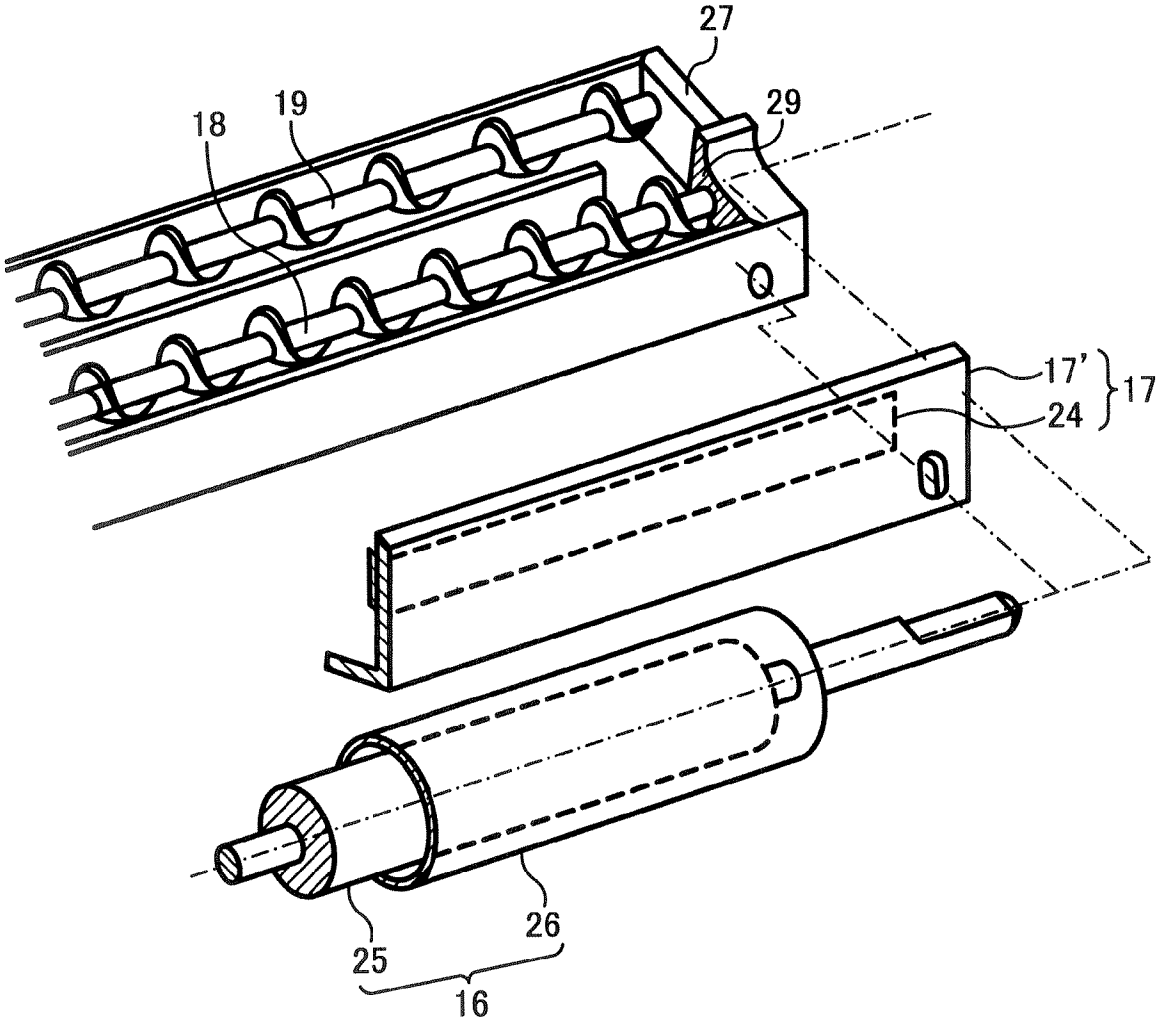
FIG. 5 is an exploded view of a portion of the developing device illustrated in FIG. 3.

FIG. 5 is an exploded view of a portion of the developing device 4. The developing roller 16 includes a magnet 25, which is fixed, and a developing sleeve 26, which is located overlying the magnet 25 while rotating to transport the developer thereon. The length of the magnet in the longitudinal direction thereof is longer than that of the image forming area of the photoreceptor such that a toner image without omissions can be formed on the photoreceptor. In this embodiment, the developing sleeve 26 is made of aluminum and have plural grooves on the surface thereof. The grooves will be explained below.

As mentioned above, the doctor 17 includes the main body 17' made of a non-magnetic material, and the auxiliary doctor 24 made of a magnetic material. The main body 17' is fixed to a casing 27 of the developing device so that a predetermined gap is formed between the tip of the main body 17' and the surface of the developing sleeve 26. As mentioned above, the main body 17' preferably has a thickness of from about 1.5 mm to 2 mm and the tip thereof preferably has a straightness of about 0.05 mm. The auxiliary doctor 24 is typically made of a metal plate having a thickness of about 0.2 mm. It is preferable to fix the auxiliary doctor 24 to the main body of the doctor by a method such as spot welding or caulking such that the gap between the tip of the main body of the doctor and the auxiliary doctor and the surface of the developing roller is controlled so as to be constant.

As illustrated in FIG. 5, the first feeding screw 18 and the second feeding screw 19 are rotatably fixed to the casing 27 via bearings (not shown). A magnetic plate 29 is provided on an inner portion of each of side plates of the casing 27 to prevent the developer from escaping from the developing device 4.

Next, the toner for use in the image forming apparatus of the present invention will be explained.

In order to reproduce images with a resolution of not less than 600 dpi (dots per inch), the toner preferably has a volume average particle diameter (Dv) of from 3 to 8 μm. When the toner has such an average particle diameter, the resultant images have good dot reproducibility because the toner size is much smaller than that of a minimum latent dot image. When the volume average particle diameter (Dv) is too small, the transfer rate and blade cleanability of the toner deteriorates. In contrast, when the volume average particle diameter (Dv) is too large, it becomes impossible to prevent occurrence of a scattering problem in that toner particles constituting images such as character images and line images are scattered.

In addition, the ratio (Dv/Dn) of the volume average particle diameter (Dv) to the number average particle diameter (Dn) of the toner is preferably from 1.00 to 1.40. As the ratio (Dv/Dn) approaches 1.00, the particle diameter distribution of the toner becomes sharp. Atoner having such a relatively small particle diameter and a sharp particle diameter distribution has a uniform charge quantity. Therefore, by using such a toner, high quality images can be produced without causing a background development problem in that the background areas of images are soiled with toner particles. In addition, by using such a toner, the toner image transfer rate can be enhanced when a toner image is transferred from an image bearing member to a receiving material using an electrostatic transfer method.

The toner for use in the image forming apparatus of the present invention preferably has a first shape factor SF-1 of from 100 to 180 and a second shape factor SF-2 of from 100 to 180.

Figure 6:
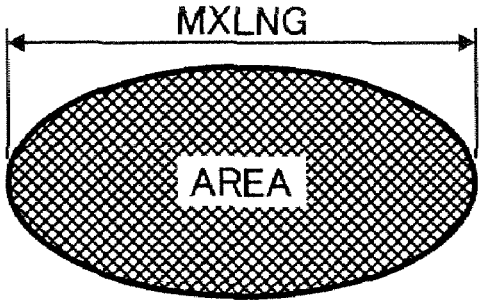
FIG. 6 is a schematic view for explaining how to determine the shape factor SF-1 of a toner particle.
Figure 7:
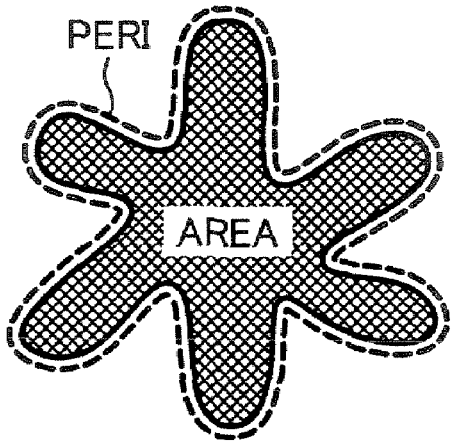
FIG. 7 is a schematic view for explaining how to determine the shape factor SF-2 of a toner particle.

FIGS. 6 and 7 are schematic views for explaining the first and second shape factors SF-1 and SF-2, respectively.

As illustrated in FIG. 6, the first shape factor SF-1 represents the degree of the roundness of a toner and is defined by the following equation (1):

$$SF\text{-}1=\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. As the SF-1 increases, the toner particles have irregular forms.

As illustrated in FIG. 7, the second shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity) As the SF-2 increases, the toner particles have a rougher surface.

The first and second shape factors SF-1 and SF-2 are determined by the following method:

(1) particles of a toner are photographed using a scanning electron microscope (S-800, manufactured by Hitachi Ltd.); and (2) photograph images of 100 toner particles are analyzed using an image analyzer (LUZEX 3 manufactured by Nireco Corp.) to determine the first and second shape factors SF-1 and SF-2.

When toner particles have a form near spherical form, the toner particles contact the other toner particles and the photoreceptor serving as an image bearing member at one point. Therefore, the adhesion of the toner particles to the other toner particles decreases and thereby fluidity of the toner can be enhanced. In addition, adhesion between the toner particles and the photoreceptor decreases, resulting in enhancement of the transferability of the toner particles. When the first and second shape factors SF-1 and SF-2 are too large, the toner has poor transferability.

Figure 8:
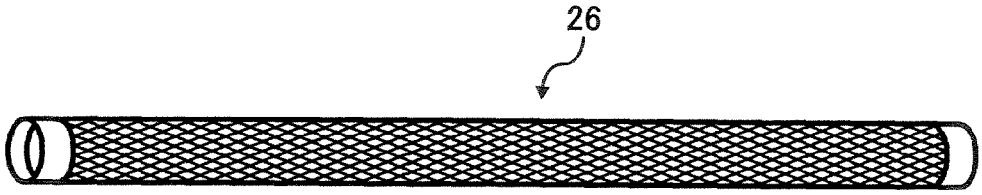
FIG. 8 is a perspective view illustrating the developing sleeve of the developing device illustrated in FIG. 3.
Figure 9A:
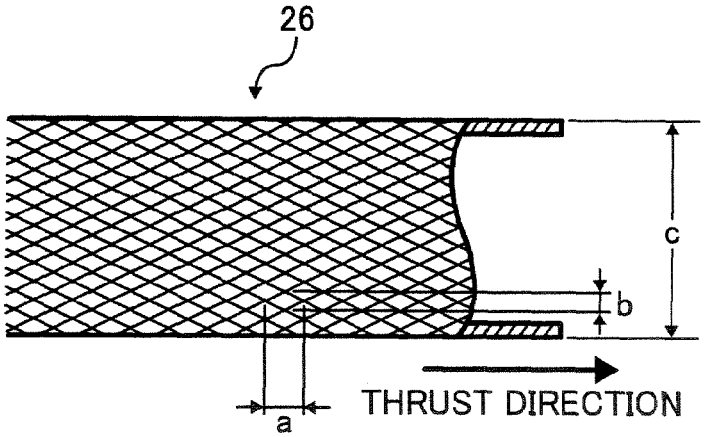
FIGS. 9A and 9B are enlarged views of the developing sleeve of the developing device illustrated in FIG. 3.
Figure 9B:
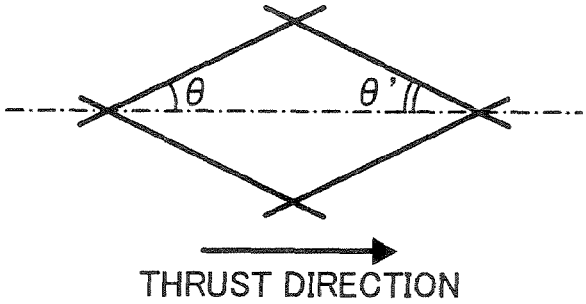

Next, the developing roller 16 serving as a developer bearing member will be explained. FIG. 8 is a perspective view of the sleeve 26 and FIGS. 9A and 9B are enlarged view of the sleeve 26. Referring to FIGS. 9A and 9B, the grooves are formed on the surface of the sleeve 26 such that plural grooves slanting at an angle of θ relative to a trust direction cross other plural grooves reversely slanting at an angle of θ' relative to the trust direction. The slanting angle (θ or θ') formed by one of the plural grooves and the thrust direction is the same as or different from those of the other grooves. In addition, the slanting angle (θ) is the same as or different from the slanting angle (θ').

When such grooves are formed on the surface of the sleeve 26, the developer hardly receives stress from the grooves at the location below (or above) the doctor 17 unlike the case where the grooves are not slanting relative to the thrust direction. Therefore, the life of the developer can be prolonged. In addition, since the grooves are slanting, a shock-jitter problem in that a jitter image is formed due to shock of the developer caused when the developer passes under (or over) the doctor 17 can be avoided.

Referring to FIG. 9A, character (a) represents the first intersection distance between two adjacent intersections in the thrust direction. Character (b) represents the second intersection distance between two adjacent intersections in the peripheral direction (i.e., the direction perpendicular to the thrust direction). Character (c) represents the outer diameter of the sleeve 26.

In this embodiment, the slanting angles (θ and θ') of each of the grooves is greater than 0° and not greater than 40°, and preferably from 5° to 40°. The first intersection distance (a) is preferably from 1.3 mm to 4.8 mm. In addition, the second intersection distance (b) preferably satisfies the following relationship:

$$0.38\ Vd/Vi \leqq b\ (\text{mm}) \leqq 1.1\ Vd/Vi,$$

wherein Vd represents the linear velocity of the surface of the rotated developer bearing member, and Vi represents the linear velocity of the surface of the rotated image bearing member.

The reason why the slanting angle is preferably greater than 0° and not greater than 40° will be explained.

Figure 10:
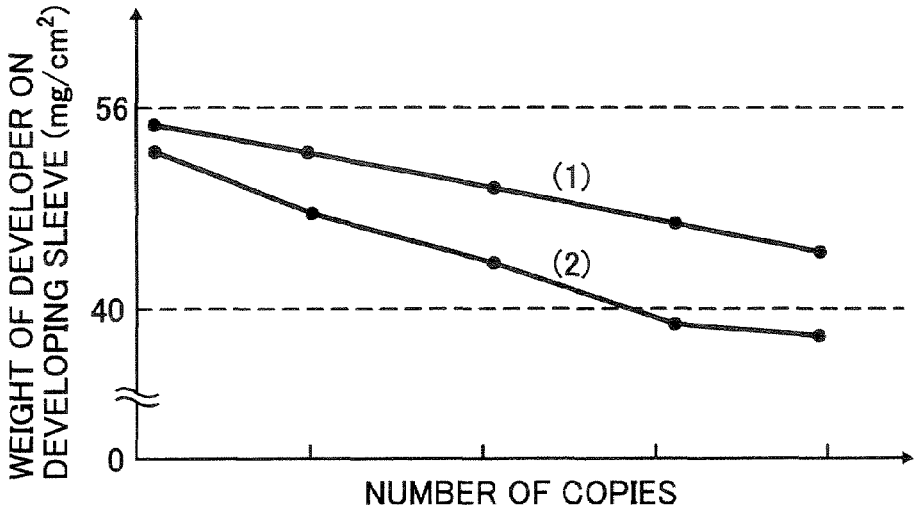
FIG. 10 is a graph illustrating change of the weight of the developer on the developing sleeve with increase of the number of copies.

FIG. 10 is a graph illustrating change of the weight per unit area of developer on the surface of each of two developing rollers (1) and (2) when the number of copies is increased. The weight per unit area is preferably from 40 mg/cm$^2$ to 56 mg/cm$^2$. When the weight is less than 40 mg/cm$^2$, image density tends to decrease. In contrast, when the weight is greater than 56 mg/cm$^2$, the developer tends to receive an excessive amount of stress at the location below (or above) the doctor. Referring to FIG. 10, the developing roller (1) could bear a proper amount of developer thereon during the test (even after the life (in this case, 160,000 copies) of the developing roller expired). In contrast, the developing roller (2) could not bear a proper amount of developer at the end of the test.

The present inventors discover that the degree of decrease in the weight of developer located on the surface of each of the developing rollers is influenced by the slanting angle of the grooves thereon. Specifically, as the slanting angle of grooves on the surface of a developing roller increases, the degree of decrease in the weight of developer on the surface of the developing roller increases. In addition, it is found that when the slanting angle is greater than 40°, the weight of developer on the surface of the developing roller becomes lower than the lower limit (40 mg/cm$^2$) before expiration of the life thereof (e.g., production of about a hundred and tens of thousand copies).

Further, a test in which the shape of the grooves is changed while the slanting angle is changed from 15° to 50° to check whether the factors influence the developer weight was performed. The results are shown in Table 1.

TABLE 1

| Slanting angle | Shape of grooves | | |
|---|---|---|---|
| | 1. Narrow V-form grooves | 2. Medium grooves | 3. Wide grooves |
| | 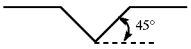 | 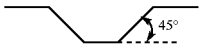 | 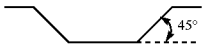 |
| | Width: 160 μm<br>Depth: 80 μm | Width: 300 μm<br>Depth: 80 μm | Width: 450 μm<br>Depth: 80 μm |
| 15° | Good | Good | Good |
| 25° | Good | Good | Good |
| 35° | Good | Good | Good |
| 40° | Good | Good | Good |
| 45° | Not acceptable | Not acceptable | Not acceptable |
| 50° | Not acceptable | Not acceptable | Not acceptable |

Good: The developing roller could bear a proper amount of developer thereon during the test in which 160,000 copies are produced.
Not acceptable: The weight of developer on the surface of the developing roller became lower than the lower limit before the test was completed.

Next, the reason why the slanting angle is preferably set such that the intersection distance (a) is from 1.3 mm to 4.8 mm will be explained.

At first, the reason why the lower limit is 1.3 mm will be explained. Recently, the gap between the surface of the developing roller 16 and the surface of the photoreceptor 1 is set so as to be typically not greater than 1 mm to produce high quality images. When the gap is narrow, good images can be formed even when the amount of the developer borne on the surface of the developing roller is decreased (e.g., 40 mg/cm$^2$). As the number of the grooves is increased (i.e., as the intersection distance is decreased), the amount of the developer borne on the surface of the developing roller can be increased. By forming grooves on the surface of the developing roller such that the first intersection distance (a) is not less than 1.3 mm, the developing roller can bear a proper amount of developer thereon. Forming too large number of grooves on the developing roller takes a long time and causes a problem in that the developing sleeve is deformed due to large stress applied to the sleeve in the groove formation operation. Therefore, the lower limit of the first intersection distance (a) is preferably 1.3 mm.

Next, the reason why the upper limit is 4.3 mm will be explained. When the first intersection distance (a) is greater than 4.3 mm, the above-mentioned vertical stripe image problem tends to be easily caused. The mechanism of formation of a vertical stripe image is as follows. The amount of developer on a groove is greater than that on a surface on which no groove is formed. In addition, the amount of developer on an intersection of grooves is greater than that on a groove. Therefore, the portion of a toner image developed by the developer on the intersection has a higher image density than the other portion of the image. In this regard, if the width of the high density portion of the toner image is too narrow, the image cannot be recognized as a vertical stripe image by human eyes. As a result of the present inventors' study, the image can be recognized as a vertical stripe image by human eyes if the width is greater than 4.8 mm. Therefore, the first intersection distance (a) is preferably not greater than 4.8 mm.

Next, the reason why the second intersection distance (b) is preferably from 0.38 Vd/Vi (mm) to 1.1 Vd/Vi (mm) will be explained.

As mentioned above, the gap between the surface of the developing roller 16 and the surface of the photoreceptor 1 is set so as to be typically not greater than 1 mm to produce high quality images, and thereby good images can be formed even when the amount of developer borne on the surface of the developing roller is decreased. The amount of developer borne on the surface of the developing roller is also influenced by the linear velocities of the developing roller and the photoreceptor at the developing region at which the developing roller and the photoreceptor face each other. In addition, as mentioned above, the amount of developer borne on the surface of the developing roller is increased when the number of grooves formed on the developing roller increases. As a result of the present inventors' study, it is found that when the second intersection distance (b) is not less than 0.38 Vd/Vi (mm), the developing roller can bear a proper amount of developer thereon. Forming too large number of grooves on the developing roller takes a long time and causes a problem in that the developing sleeve is deformed due to large stress applied to the sleeve in the groove formation operation. Therefore, the lower limit is set to 0.38 Vd/Vi (mm).

Next, the reason why the upper limit is 1.1 Vd/Vi will be explained. When the second intersection distance (b) is greater than 1.1 Vd/Vi, the above-mentioned horizontal stripe image problem tends to be easily caused. As mentioned above, the amount of developer on an intersection of grooves is greater than that on a grove or the surface on which no groove is formed. Therefore, the portion of a toner image developed by the developer on the intersection has a higher image density than the other portion of the toner image. As a result of the present inventors' study, the image can be recognized as a horizontal stripe image by human eyes if the width is greater than 1.1 mm. Therefore, the second intersection distance (b) is preferably not greater than 1.1 Vd/Vi (mm), which is determined while considering the linear velocities of the sleeve and the photoreceptor.

The first and second intersection distances (a) and (b) of the grooves formed on the developing rollers described in Table 1 are shown in Table 2.

TABLE 2

| Slanting angle (°) | First intersection distance (a) (mm) | Second intersection distance (b) (mm) |
|---|---|---|
| 15 | 5.26 | 1.41 |
| 25 | 3.02 | 1.41 |
| 35 | 2.01 | 1.41 |
| 40 | 1.68 | 1.41 |
| 45 | 1.41 | 1.41 |
| 50 | 1.18 | 1.41 |

The other conditions of the test are as follows.

Diameter of developing roller: 18 mm

Linear velocity of photoreceptor: 150 mm/s

Linear velocity of developing sleeve: 290 mm/s

Number of grooves: 80 (40+40 (reversely slanting grooves))

In this regard, the second intersection distance (b) is determined as follows:

$$18\times\pi/40=1.41\ (\text{mm})$$

This second intersection distance (b) falls in the preferable range of from 0.73 (0.38×290/150) mm to 2.1 (1.1×290/150) mm.

The intersection distances (a) and (b) and the slanting angle (θ or θ') satisfy the following relationship:

$$\tan(\theta)(\text{or } \tan(\theta'))=a/b.$$

The sleeve 26 preferably has a diameter of from 10 mm to 32 mm. The lower limit is determined in view of the transportability of the developer while considering the pattern magnetism of the magnet 25, and the upper limit is determined in view of process ability of the sleeve. For example, when the linear velocities of the photoreceptor 1 and developing sleeve 26 are 150 mm/s and 290 mm/s, respectively, and the second intersection distance (b) is 2.2 mm, which is near the upper limit (2.1 mm), the number of intersections is 14 if the diameter of the developing sleeve is 10 mm. In this case, the pitch (angle) between two adjacent intersections in the peripheral direction is about 25°. This angle (25°) is greater than the half-width angle of a pattern magnetism of the magnet 25, and therefore the transportability of the developer on the sleeve deteriorates. In contrast, when the diameter is 32 mm, the number of intersections is 134 if the pitch is 0.75 mm. It is difficult to form such a large number of grooves on a sleeve.

EXAMPLE 1

When the following developing roller was used for the image forming apparatus illustrated in FIG. 1, good images without horizontal stripe images were produced.

Diameter of developing roller: 18 mm

First intersection distance (a): changed in a range of from 1.3 mm to 4.8 mm.

Second intersection distance (b): changed in a range of from 0.75 mm to 2.2 mm.

The linear velocities of the developing sleeve and the photoreceptor were set to be 290 m/s and 150 mm/s, respectively.

As a result, the developing rollers having grooves having a slanting angle of from 15° to 40° could bear a proper amount of developer thereon in the above-mentioned range during the test in which 160,000 copies are produced.

Another embodiment of the developer bearing member will be explained referring to drawings.

Figure 11A:
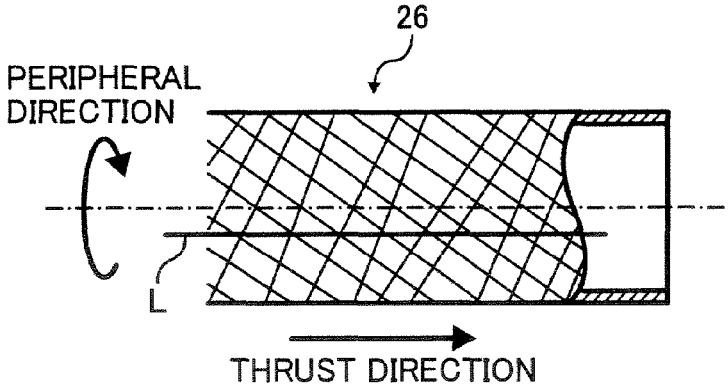
FIG. 11 is an enlarged view of another embodiment of the developing sleeve, which can prevent formation of a vertical stripe image.
Figure 11B:
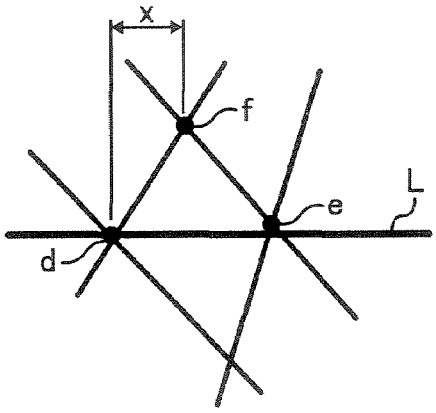

FIG. 11A is an enlarged view of a developer bearing member, which may cause the horizontal stripe image problem, and FIG. 11B is an enlarged view of a portion of the developer bearing member.

Referring to FIG. 11A, two adjacent intersections (d) and (e) in the thrust direction are on substantially the same level in the peripheral direction, i.e., the intersections (d) and (e) are on a line L which is parallel to the thrust direction. Therefore, a horizontal stripe image tends to be formed. However, two adjacent intersections (d) and (f) are not on the same level in the thrust direction, i.e., the positions of the intersections (d) and (f) are different by (x) in the thrust direction. Therefore, a vertical stripe image is not formed.

Figure 12A:
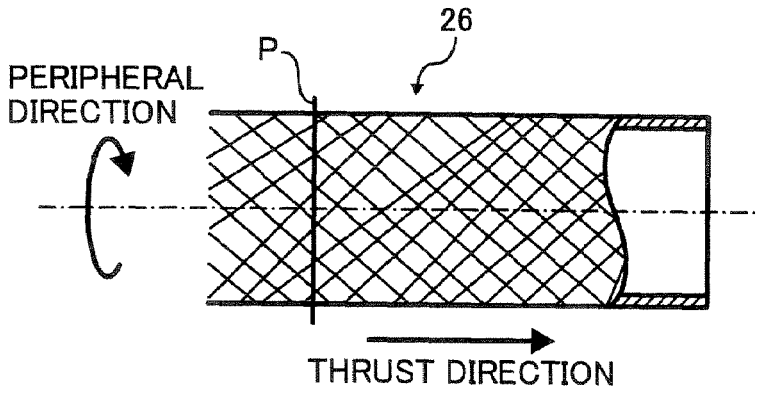
FIG. 12 is an enlarged view of another embodiment of the developing sleeve, which can prevent formation of a horizontal stripe image.
Figure 12B:
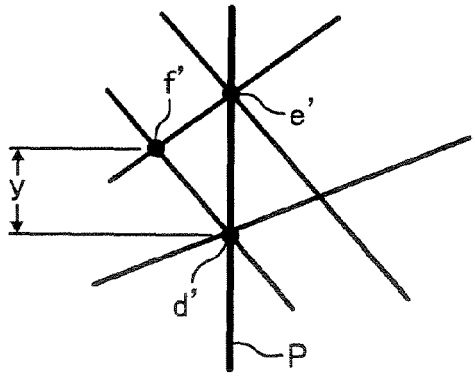

FIG. 12A is an enlarged view of a developer bearing member, which may cause the vertical stripe image problem, and FIG. 12B is an enlarged view of a portion of the developer bearing member. In contrast with the developer bearing member illustrated in FIG. 12A, two adjacent intersections (d') and (e') in the peripheral direction are on substantially the same level in the thrust direction, i.e., the intersections (d') and (e') are on a line P which is parallel to the peripheral direction. Therefore, a vertical stripe image tends to be formed. However, two adjacent intersections (d') and (f') are not on the same level in the peripheral direction, i.e., the positions of the intersections (d') and (f') are different by (y) in the peripheral direction. Therefore, a horizontal stripe image is not formed.

Figure 13:
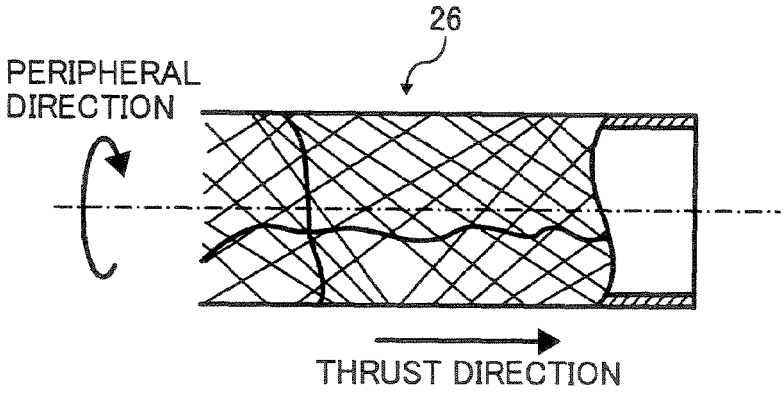
FIG. 13 is an enlarged view of another embodiment of the developing sleeve, which can prevent formation of a vertical stripe image and a horizontal stripe image.

FIG. 13 is a schematic view illustrating a preferable developer bearing member, which causes neither a horizontal stripe image nor a vertical stripe image because two adjacent intersections in the thrust direction are not on the same level in the peripheral direction, and in addition two adjacent intersections in the peripheral direction are not on the same level in the thrust direction.

Figure 14:
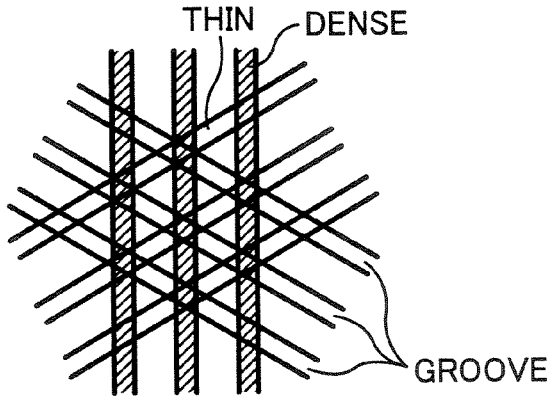
FIG. 14 is a view for explaining how a vertical stripe image is formed.

FIG. 14 is a schematic view for explaining how a (vertical) stripe image is formed. As mentioned above, the amount of developer on a groove is greater than that on a surface on which no groove is formed. In addition, the amount of developer on an intersection of grooves is greater than that on a groove. Therefore, the portion of a toner image developed by the developer on the intersection has a higher image density than the other portion of the toner image. When intersections are arranged on the same level in the thrust direction as illustrated in FIG. 14, a vertical stripe image is formed as illustrated in FIG. 14. In this regard, if the width of the high density portion of the image is too narrow, the image cannot be recognized as a vertical stripe image by human eyes. As a result of the present inventors' study, the image can be recognized as a vertical stripe image by human eyes if the width between two adjacent stripes is greater than 4.8 mm. Therefore, the first intersection distance (a) is preferably not greater than 4.8 mm. As mentioned above, the lower limit of the first intersection distance (a) is preferably 1.3 mm in view of productivity of the developing sleeve.

EXAMPLE 2

When the following developing roller was used for the image forming apparatus illustrated in FIG. 1, good images without horizontal stripe images were produced.

Diameter of developing roller: 18 mm

Number of grooves: 80 (40+40 (reversely slanting grooves))

Slanting angle (θ or θ'): 25°

Angle of vertical wall of groove: 90°

Width of groove: 240 μm

Depth of groove: 90 μm

Weight of developer drawn by sleeve: 48 mg/cm$^2$ (±8 mg/cm$^2$)

Doctor gap: 0.34 mm

Gap between surface of developing sleeve and surface of photoreceptor (development gap): 0.3 mm (±0.05 mm)

Next another embodiment of the developer bearing member will be explained.

Figure 15:
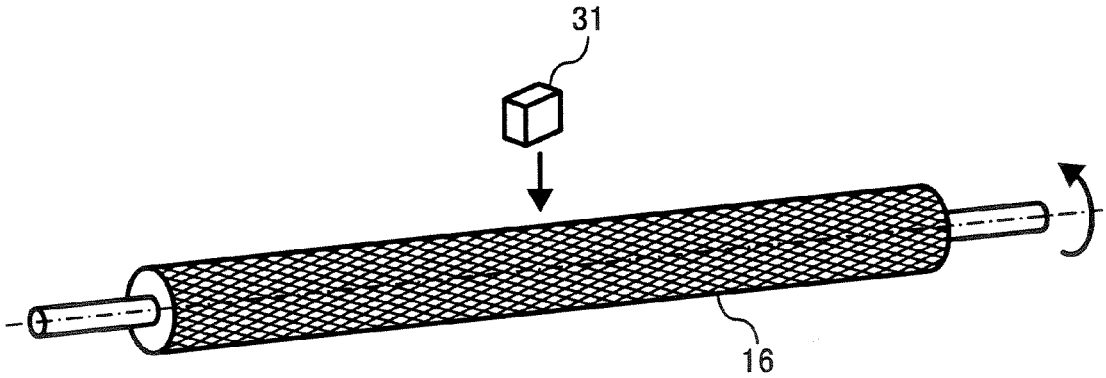
FIG. 15 is a schematic view for explaining how to determine the depth of grooves formed on the surface of a developing sleeve.
Figure 16:
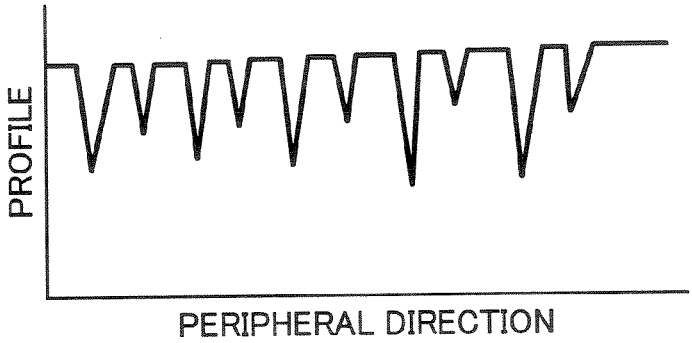
FIG. 16 is a schematic view illustrating the profile of a peripheral surface of a developing sleeve.

FIG. 15 is a schematic view for explaining how to determine the deviation of depth of grooves. At first, the developing roller 16 is rotated while both the ends of the rotation shaft of the roller are supported. The distance between a point of the surface of the developing roller and an instrument 31 is measured with the instrument to determine the variation in the distance (i.e., the variation in position of the surface of the developing roller). Thus, the profile of the position of the surface of the developing roller in the peripheral direction thereof is obtained. The profile is illustrated in FIG. 16. In FIG. 16, a recessed portion corresponds to a groove.

Figure 17A:
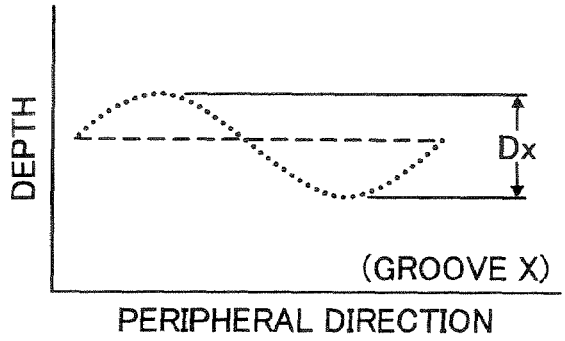
FIGS. 17A-17C are graphs illustrating depth of grooves formed on the surface of a developing sleeve.
Figure 17B:
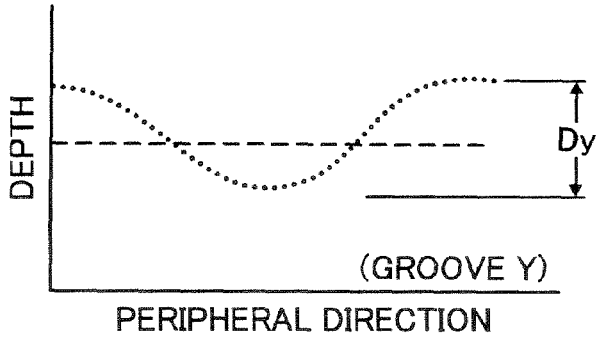

FIG. 17A is a graph in which the depth of grooves X, which are normally slanting relative to the thrust direction, are plotted and FIG. 17B is a graph in which the depth of grooves Y, which are reversely slanting relative to the thrust direction, are plotted. In reality, a groove X and a groove Y are alternatively arranged on the surface of the developing roller in the peripheral direction thereof. Therefore, the graph illustrated in FIG. 17A is prepared by deleting the data of thegrooves Y. Similarly, the graph illustrated in FIG. 17B is prepared by deleting the data of the grooves X. When the profile is obtained, it is preferable not to measure a profile of an intersection of grooves X and Y.

Referring to FIGS. 17A and 17B, character Dx denotes the deviation in depth of the grooves X and character Dy denotes the deviation in depth of the grooves Y. As illustrated in FIGS. 17A and 17B, the deviations Dx and Dy are determined as the difference between the maximum value of the groove and the minimum value thereof.

The reason why the depth of the grooves has such deviations is as follows. The grooves are formed by cutting. Specifically, at first the grooves X are formed on the surface of a sleeve using a die having cutting tools whose number is the same as that of the grooves X. Then the grooves Y are formed on the surface of a sleeve using a die having cutting tools whose number is the same as that of the grooves Y. In this case, the depth of the grooves varies due to deviation in position of the cutting tools and the sleeve to be cut, etc., and therefore the depth of the grooves has deviations. As illustrated in FIGS. 17A and 17B, the curve illustrating the deviation in depth of the grooves X (FIG. 17A) has a phase different from the curve illustrating the deviation in depth of the grooves Y (FIG. 17B). When the deviation in depth of grooves is too large, a problem in that an uneven density image is formed due to the grooves having uneven depth occurs. Therefore, it is necessary to control the deviation in depth of the grooves so as to fall in a proper range.

Figure 17C:
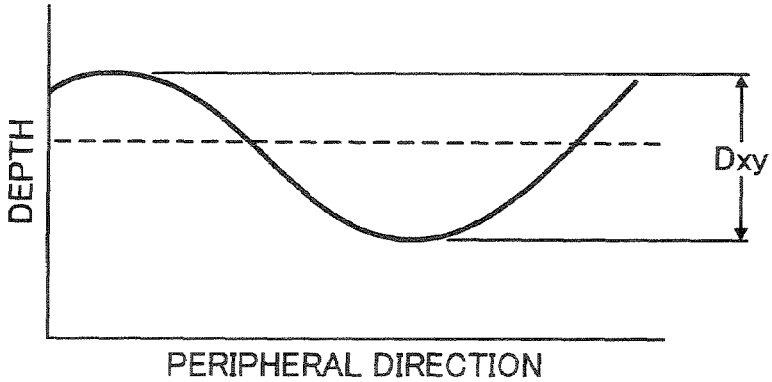

FIG. 17C is a graph prepared by plotting the average depth of adjacent nine grooves (including four or five grooves X and five or four grooves Y) in the peripheral direction of the developing roller. In this embodiment, 40 grooves X and 40 grooves Y are formed on the surface of the developing roller. Therefore, the fan-form section formed by nine grooves and the center of the developing roller has an angle of 36° (360×(9−1)/80) In FIG. 17C, the difference Dxy between the maximum value and the minimum value is defined as a synthesized deviation in depth of the grooves X and Y. The present inventors discover that by controlling the synthesized deviation in depth so as to fall in a proper range, formation of uneven density images can be avoided. The reason is explained below.

Figure 18:
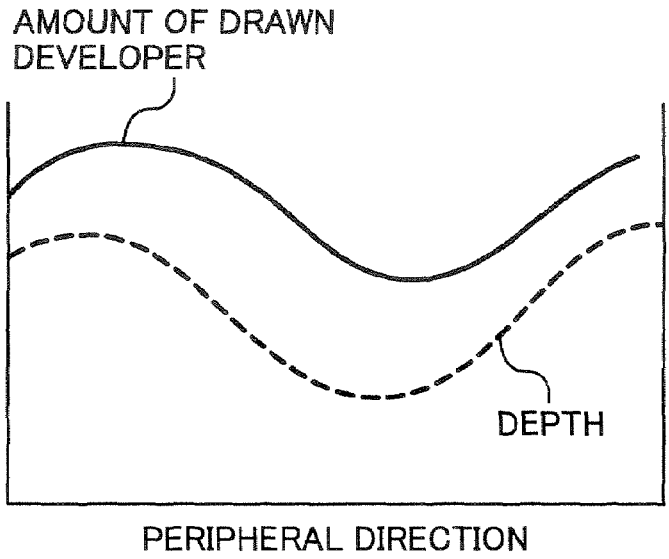
FIG. 18 is a graph illustrating the relationship between the depth of grooves formed on a developing sleeve and the amount of developer drawn by the developing sleeve.

As illustrated in FIG. 18, the amount (weight) of the developer drawn by the surface of the developing sleeve, which is illustrated by a solid line, changes depending on the depth of the grooves X and Y, which is illustrated by a dotted line.

Figure 19:
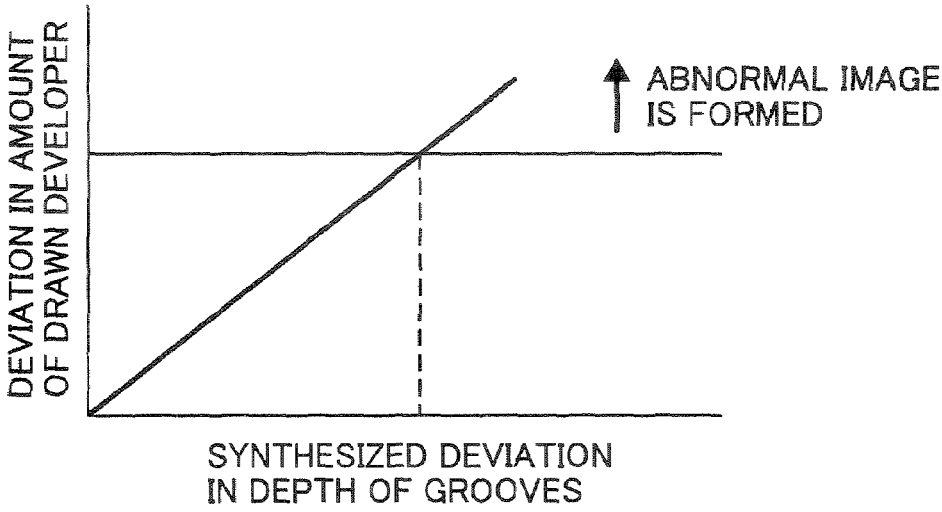
FIG. 19 is a graph illustrating the relationship among deviation in the amount of the drawn developer, synthesized deviation in depth of grooves and formation of abnormal images.

FIG. 19 is a graph illustrating the relationship between the deviation in amount (weight) of the developer drawn by the grooves and the synthesized deviation in depth of the grooves. It can be understood from FIG. 19 that the deviation in amount (weight) of the developer drawn by the grooves linearly changes depending on the synthesized deviation in depth of the grooves, and when the deviation in amount (weight) of the developer drawn by the grooves exceeds a certain value (hereinafter referred to as an abnormal image level), an abnormal image (i.e., an uneven image) is formed.

In addition, the present inventors discover that the abnormal image level changes depending on the development gap (i.e., the gap between the surface of the developing roller and the surface of the photoreceptor). Specifically, as the development gap narrows, the abnormal image level decreases. This is illustrated in FIG. 20.

Figure 20:
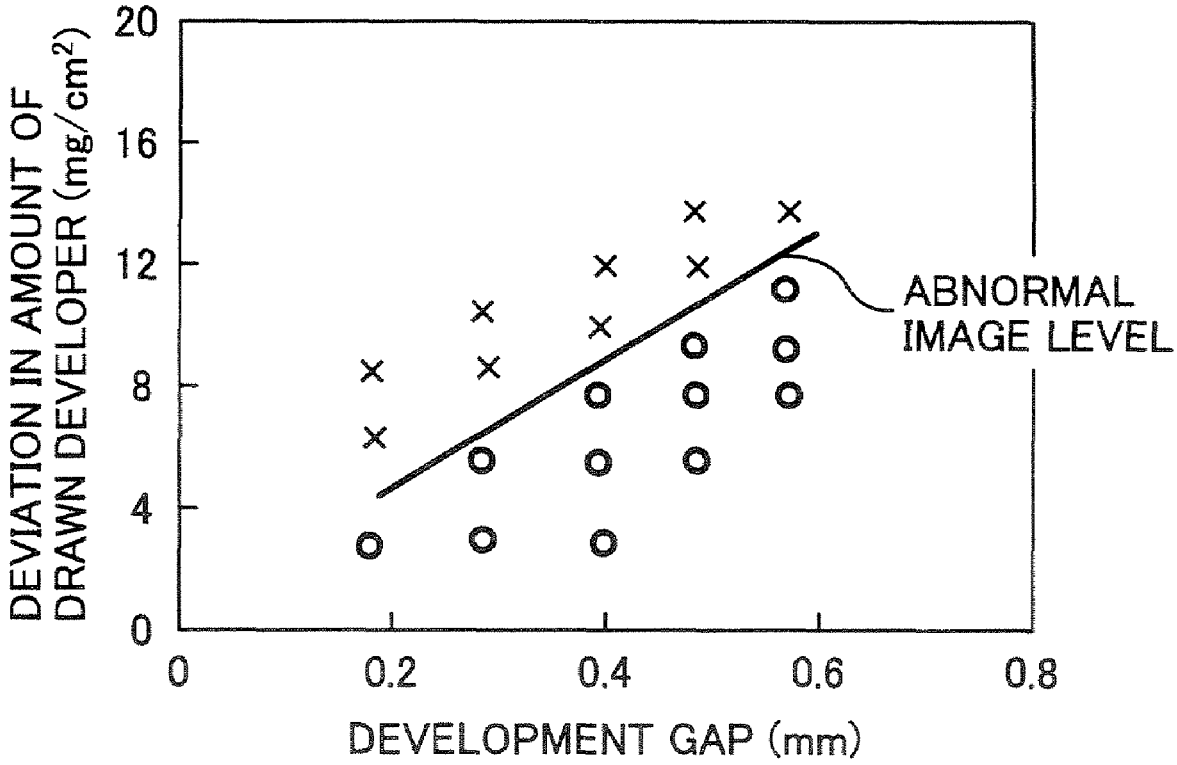
FIG. 20 is a graph illustrating the relationship among the deviation in the amount of the drawn developer, the development gap and formation of abnormal images.

In FIG. 20, the development gap is plotted on the X-axis, and the deviation in amount (weight) of the developer drawn by the grooves and the synthesized deviation in depth of the grooves are plotted on the Y-axis. A circle (○) mark represents that no uneven density image is formed, and a cross (X) mark represents that an uneven density image is formed. As illustrated in FIG. 20, as the development gap increases, the abnormal image level increases. The abnormal image line is represented by the following equation:

$$y=0.15x$$

wherein y represents the synthesized deviation in depth of the grooves and x represents the development gap.

Therefore, the synthesized deviation in depth of the grooves is preferably not greater than 15% of the development gap.

This equation can be applied even when the covering ratio (CR) at which a carrier particle is covered with toner particles is changed in a range of from 15 to 75%, and the amount of the developer drawn by the grooves is changed in a range of from 25 to 85 mg/cm$^2$. In this regard, the covering ratio is represented by the following equation:

$$CR=\{c/(1-c)\}\times(R/r)^3\times(\rho_c/\rho_t)\times(3^{1/2}/2\pi)\times\{r/(R+r)\}^2$$

wherein R represents the particle diameter of the carrier particle; r represents the particle diameter of the toner particles on the carrier particle; $\rho_c$ represents the true specific gravity of the carrier particle; $\rho_t$ represents the true specific gravity of the toner particles; and c represents the concentration (% by weight) of the toner in the developer.

Thus, it is preferable that the synthesized deviation in depth of the grooves is not greater than 15% of the development gap. Since the synthesized deviation is the sum of the deviation of the grooves normally slanting relative to the thrust direction and the grooves reversely slanting relative to the thrust direction, it is preferable that the groove forming conditions (i.e., the cutting conditions) are controlled such that the deviation in depth of the grooves normally slanting relative to the thrust direction (or the reversely slanting grooves) is not greater than 7.5% (i.e., 15/2) of the development gap. Specifically, the cutting conditions means the conditions of the sleeve (i.e., the object to be cut) and die used for cutting.

This document claims priority and contains subject matter related to Japanese Patent Applications Nos. 2005-321629, 2005-345049, 2005-321628, 2005-321627, 2005-321625 and 2005-321626, filed on Nov. 4, 2005, Nov. 30, 2005, Nov. 4, 2005, Nov. 4, 2005, Nov. 4, 2005, and Nov. 4, 2005, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developer bearing member for bearing a developer including a toner while rotating to visualize a latent image on a surface of a rotating latent image bearing member using the developer, said developer bearing member having a surface on which grooves are formed such that plural grooves slanting in a thrust direction of the developer bearing member cross other plural grooves reversely slanting relative to the thrust direction, wherein each of the plural grooves and the reversely slanting plural grooves is slanting at an angle of greater than 0° and not greater than 40°.

2. The developer bearing member according to claim 1, wherein a distance (a) between any two adjacent intersections of the plural grooves and the reversely slanting plural grooves in the trust direction is from 1.3 mm to 4.8 mm.

3. The developer bearing member according to claim 1, wherein a distance (b) between any two adjacent intersections of the plural grooves and the reversely slanting plural grooves in a peripheral direction of the developer bearing member satisfies the following relationship:

$$0.38\ Vd/Vi\ (mm) \leqq b \leqq 1.1\ Vd/Vi\ (mm),$$

wherein Vd represents a linear velocity of the surface of the developer bearing member, and Vi represents a linear velocity of the surface of the rotating latent image bearing member.

4. A developing device comprising:

the developer bearing member according to claim 1;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

5. A process cartridge comprising:

the developing device according to claim 4; and at least one member selected from the group consisting of a latent image bearing member configured to bear a latent image to be developed by the developing device, a charging device configured to charge the latent image bearing member, and a cleaning device configured to clean the surface of the latent image bearing member.

6. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 4.

7. The image forming apparatus according to claim 6, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

8. The image forming apparatus according to claim 6, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

9. The image forming apparatus according to claim 6, wherein the toner has a first shape factor SF-1 of from 100 to 180, and a second shape factor of from 100 to 180.

10. A developer bearing member for bearing a developer including a toner while rotating to visualize a latent image on a surface of a rotating latent image bearing member using the developer, said developer bearing member having a surface on which grooves are formed such that plural grooves slanting in a thrust direction of the developer bearing member cross other plural grooves reversely slanting relative to the thrust direction, wherein a distance (a) between any two adjacent intersections of the plural grooves and the reversely slanting plural grooves in the trust direction is from 1.3 mm to 4.8 mm, and wherein a distance (b) between any two adjacent intersections of the plural grooves and the reversely slanting plural grooves in a peripheral direction of the developer bearing member satisfies the following relationship:

$$0.38\ Vd/Vi\ (mm) \leqq b \leqq 1.1\ Vd/Vi\ (mm),$$

wherein Vd represents a linear velocity of the surface of the developer bearing member, and Vi represents a linear velocity of the surface of the rotating latent image bearing member.

11. The developer bearing member according to claim 10, wherein the developer bearing member has an outer diameter of from 10 mm to 32 mm.

12. A developing device comprising:

the developer bearing member according to claim 10;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

13. A process cartridge comprising:

the developing device according to claim 12; and at least one member selected from the group consisting of a latent image bearing member configured to bear a latent image to be developed by the developing device, a charging device configured to charge the latent image bearing member, and a cleaning device configured to clean the surface of the latent image bearing member.

14. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 12.

15. The image forming apparatus according to claim 14, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

16. The image forming apparatus according to claim 14, wherein the toner has a first shape factor SF-1 of from 100 to 180, and a second shape factor of from 100 to 180.

17. The image forming apparatus according to claim 14, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

18. A developer bearing member for bearing a developer including a toner, having a surface on which grooves are formed such that plural grooves slanting in a thrust direction of the developer bearing member cross other plural grooves reversely slanting relative to the thrust direction, wherein any two adjacent intersections of the plural grooves and the reversely slanting plural grooves in the thrust direction of the developer bearing member are on different levels in a peripheral direction of the developer bearing member.

19. A developing device comprising:

the developer bearing member according to claim 18;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

20. A process cartridge comprising:

the developing device according to claim 19; and at least one member selected from the group consisting of a latent image bearing member configured to bear a latent image to be developed by the developing device, a charging device configured to charge the latent image bearing member, and a cleaning device configured to clean the surface of the latent image bearing member.

21. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 19.

22. The image forming apparatus according to claim 21, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

23. The image forming apparatus according to claim 21, wherein the toner has a first shape factor SF-1 of from 100 to 180, and a second shape factor of from 100 to 180.

24. The image forming apparatus according to claim 21, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

25. A developer bearing member for bearing a developer including a toner, having a surface on which grooves are formed such that plural grooves slanting in a thrust direction of the developer bearing member cross other plural grooves reversely slanting relative to the thrust direction, wherein any two adjacent intersections of the plural grooves and the reversely slanting plural grooves in a peripheral direction of the developer bearing member are on different levels in the thrust direction of the developer bearing member.

26. The developer bearing member according to claim 25, wherein any two adjacent intersections of the plural grooves and the reversely slanting plural grooves in the thrust direction of the developer bearing member are on different levels in the peripheral direction of the developer bearing member.

27. A developing device comprising:

the developer bearing member according to claim 25;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

28. A process cartridge comprising:

the developing device according to claim 27; and at least one member selected from the group consisting of a latent image bearing member configured to bear a latent image to be developed by the developing device, a charging device configured to charge the latent image bearing member, and a cleaning device configured to clean the surface of the latent image bearing member.

29. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 27.

30. The image forming apparatus according to claim 29, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

31. The image forming apparatus according to claim 29, wherein the toner has a first shape factor SF-1 of from 100 to 180, and a second shape factor of from 100 to 180.

32. The image forming apparatus according to claim 29, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

33. A developer bearing member for bearing a developer including a toner, having a surface on which grooves are formed such that plural grooves slanting in a thrust direction of the developer bearing member cross other plural grooves reversely slanting relative to the thrust direction, wherein a distance (a) between any two adjacent intersections of the plural grooves and the reversely slanting plural grooves in the trust direction is from 1.3 mm to 4.8 mm.

34. A developing device comprising:

the developer bearing member according to claim 33;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

35. A process cartridge comprising:

the developing device according to claim 34; and at least one member selected from the group consisting of a latent image bearing member configured to bear a latent image to be developed by the developing device, a charging device configured to charge the latent image bearing member, and a cleaning device configured to clean the surface of the latent image bearing member.

36. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 34.

37. The image forming apparatus according to claim 36, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

38. The image forming apparatus according to claim 36, wherein the toner has a first shape factor SF-1 of from 100 to 180, and a second shape factor of from 100 to 180.

39. The image forming apparatus according to claim 36, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

40. A developer bearing member for bearing a developer including a toner while rotating to visualize a latent image on a surface of a rotating latent image bearing member using the developer, said developer bearing member having a surface on which grooves are formed such that plural grooves slanting in a thrust direction of the developer bearing member cross other plural grooves reversely slanting relative to the thrust direction, wherein a distance (b) between any two adjacent intersections of the plural grooves and the reversely slanting plural grooves in a peripheral direction of the developer bearing member satisfies the following relationship:

$$0.38\ Vd/Vi\ (mm) \leqq b \leqq 1.1\ Vd/Vi\ (mm),$$

wherein Vd represents a linear velocity of the surface of the developer bearing member, and Vi represents a linear velocity of the surface of the rotating latent image bearing member.

41. The developer bearing member according to claim 40, wherein the developer bearing member has an outer diameter of from 10 mm to 32 mm.

42. A developing device comprising:

the developer bearing member according to claim 40;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

43. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 42.

44. The image forming apparatus according to claim 43, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

45. The image forming apparatus according to claim 43, wherein the toner has a first shape factor SF-1 of from 100 to 180, and a second shape factor of from 100 to 180.

46. The image forming apparatus according to claim 43, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

47. A process cartridge comprising:

the developing device according to claim 42; and at least one member selected from the group consisting of a latent image bearing member configured to bear a latent image to be developed by the developing device, a charging device configured to charge the latent image bearing member, and a cleaning device configured to clean the surface of the latent image bearing member.

48. A developer bearing member for bearing a developer including a toner while rotating to visualize a latent image on a surface of a rotating latent image bearing member using the developer, said developer bearing member having a surface on which grooves are formed such that plural grooves slanting in a thrust direction of the developer bearing member cross other plural grooves reversely slanting relative to the thrust direction, wherein a difference between a maximum value and a minimum value of depth of grooves of the plural grooves and the reversely slanting plural grooves present on an arc surface portion of a cross section of the developer bearing member is not greater than 15% of a gap between the latent image bearing member and the developer bearing member, wherein a sector formed by a center of the cross section and the arc surface portion has an angle of 36°.

49. A developing device comprising:

the developer bearing member according to claim 48;

a developer container containing the developer, wherein the developer is a two-component developer including a toner and a magnetic carrier;

a developer feeding member configured to feed the developer in the developer container to the developer bearing member while agitating the developer; and a developer layer thickness controlling member configured to control a thickness of a developer layer on the developer bearing member.

50. A process cartridge comprising:

the developing device according to claim 49; and at least one member selected from the group consisting of a latent image bearing member configured to bear a latent image to be developed by the developing device, a charging device configured to charge the latent image bearing member, and a cleaning device configured to clean the surface of the latent image bearing member.

51. An image forming apparatus comprising:

a latent image bearing member configured to bear a latent image thereon; and a developing device configured to develop the latent image with a developer including a toner to form a toner image on the latent image bearing member, wherein the developing device is the developing device according to claim 49.

52. The image forming apparatus according to claim 51, wherein the toner has a volume average particle diameter (Dv) of from 3 to 8 μm, and a ratio (Dv/Dn) of the volume average particle diameter (Dv) to a number average particle diameter (Dn) of the toner is from 1.00 to 1.40.

53. The image forming apparatus according to claim 51, wherein the toner has a first shape factor SF-1 of from 100 to 180, and a second shape factor of from 100 to 180.

54. The image forming apparatus according to claim 51, further comprising:

a charging device configured to charge the latent image bearing member; and a cleaning device configured to clean a surface of the latent image bearing member, wherein the developing device and at least one member selected from the group consisting of the latent image bearing member, the charging device, and the cleaning device are unitized as a process cartridge, which is detachably attached to the image forming apparatus.

* * * * *